US008387353B2

(12) United States Patent
Mullebrouck et al.

(10) Patent No.: US 8,387,353 B2
(45) Date of Patent: Mar. 5, 2013

(54) OFF-THE-ROAD STEEL CORD WITH CRIMPED STRANDS

(75) Inventors: Rik Mullebrouck, Wevelgem (BE); Zhichao Cheng, Jiangyin (CN)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 13/130,973

(22) PCT Filed: Nov. 23, 2009

(86) PCT No.: PCT/EP2009/065629

§ 371 (c)(1), (2), (4) Date: May 24, 2011

(87) PCT Pub. No.: WO2010/060878

PCT Pub. Date: Jun. 3, 2010

(65) Prior Publication Data

US 2011/0225944 A1 Sep. 22, 2011

(30) Foreign Application Priority Data

Nov. 25, 2008 (EP) ..... 08169886

(51) Int. Cl.
*D02G 3/22* (2006.01)

(52) U.S. Cl. ..... 57/237; 57/311

(58) Field of Classification Search ..... 57/237, 57/311

See application file for complete search history.

(56) References Cited

U.S. PATENT DOCUMENTS

| | | | | |
|---|---|---|---|---|
| 2,274,699 | A * | 3/1942 | Jacobs | 140/71 C |
| 2,476,180 | A | 7/1949 | Charles | |
| 3,805,853 | A * | 4/1974 | Gladu | 140/105 |
| 4,195,469 | A | 4/1980 | Tarantola | |
| 5,020,312 | A * | 6/1991 | Watakabe | 57/200 |
| 5,111,649 | A * | 5/1992 | Watakabe | 57/311 |
| 5,581,990 | A * | 12/1996 | Van Giel et al. | 57/311 |
| 5,584,169 | A * | 12/1996 | Ikehara | 57/212 |
| 5,606,852 | A * | 3/1997 | Yanagisawa | 57/207 |
| 5,651,246 | A * | 7/1997 | Kusaba | 57/311 |
| 5,661,966 | A * | 9/1997 | Matsumaru | 57/237 |
| 5,707,467 | A * | 1/1998 | Matsumaru et al. | 152/527 |
| 6,247,298 | B1 * | 6/2001 | Bourgois et al. | 57/214 |

(Continued)

FOREIGN PATENT DOCUMENTS

| | | |
|---|---|---|
| EP | 1630002 B1 | 12/2009 |
| JP | 10-131066 A | 5/1998 |

(Continued)

OTHER PUBLICATIONS

Polygonally Preformed Steel Elements, Research Disclosure, Jul. 1994, pp. 359-365, No. 363, Mason Publications, Hampshire, GB.

(Continued)

*Primary Examiner* — Shaun R Hurley
(74) *Attorney, Agent, or Firm* — Foley & Lardner LLP

(57) ABSTRACT

A steel cord (10) adapted for the reinforcement of rubber products, the steel cord (10) comprises a core (12) and three or more outer strands (14) twisted around the core (12) in a cord twisting direction. The outer strands (14) comprise outer filaments (16) twisted in a strand twisting direction which is the same as the cord twisting direction. The outer strands (14) have a wavy form which makes spaces between the core (12) and the outer strands. The steel cord (10) has improvements on elongation at break and impact resistance capacity.

3 Claims, 2 Drawing Sheets

U.S. PATENT DOCUMENTS

Figure 1:
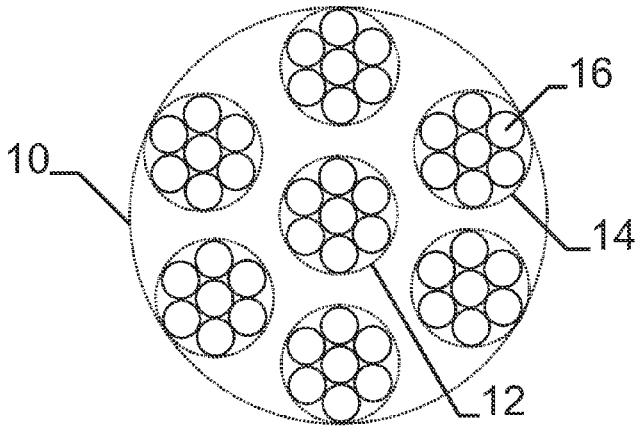

| | | | | |
|---|---|---|---|---|
| 6,311,466 | B1 * | 11/2001 | De Vos et al. | 57/212 |
| 6,438,932 | B1 * | 8/2002 | De Vos et al. | 57/212 |
| 2002/0062636 | A1 | 5/2002 | De Vos et al. | |
| 2004/0020578 | A1 | 2/2004 | Sinopoli et al. | |
| 2004/0250937 | A1 * | 12/2004 | Miyazaki | 152/527 |
| 2007/0130905 | A1 * | 6/2007 | Kish | 57/237 |

FOREIGN PATENT DOCUMENTS

| | | | |
|---|---|---|---|
| JP | 2006-104636 | A | 4/2006 |
| JP | 2006-283199 | A | 10/2006 |

OTHER PUBLICATIONS

E. Wolf et al, Alternative Konstruktionen Von Stahlzugträgern in Fördergurten, Kautschuk Und Gummi, Sep. 1993, pp. 727-731, vol. 46, No. 9.

Anonymous, Vehicle Tyre Reinforcement, Research Disclosure, Dec. 1981, p. 456, vol. 212, No. 22, Mason Publications, Hampshire GB.

* cited by examiner

OFF-THE-ROAD STEEL CORD WITH CRIMPED STRANDS

TECHNICAL FIELD

The invention relates to a steel cord adapted to reinforce rubber products, more specifically for heavy duty tires such as the off-the-road tires and earthmover tires.

BACKGROUND ART

The large off-the-road pneumatic tires used in heavy construction and earthmoving operations have operating loads and inflation pressures much higher than conventional trucks and lightweight vehicles. Therefore, the radial ply earthmover tires exhibit tremendous load-carrying capacity and need particular reinforcing cords.

JP10131066A discloses a 7×7 cord to meet this load-carrying requirement. JP 2006104636A further discloses a 1×(3+9)+6×(3+9) cord wherein the twisting direction of the strands is the same as the twisting direction of the cord.

Besides, the other concern for the performance of the off-the-road tire is insuring adequate rubber penetration into the cords, which is achieved during the manufacture of the belt layers and in subsequent tire vulcanization. Coupled to this better rubber flow is a desire for higher steel mass and improved wire cut resistance to improve the tires' overall durability. A further requirement for steel cord reinforcing off-road tire is impact resistance capacity, because the surface off the road is not as smooth as the surface of a paved highway. Improved impact resistance capacity not only prolongs the lifetime of the tire but also makes drivers more comfortable when travelling on a bumpy surface.

US2004/0020578A1 discloses a multiple filament diameters in a 7×7 cord design to increase the filament spacings in the cord, which allows better rubber penetration for improved resistance to corrosion as well as superior cut resistance. However, the increased void area in the cord cuts the area of load-bearing steel filaments, which undermines the load-carry capacity of the cord.

DISCLOSURE OF INVENTION

It is an object of the invention to provide a multi-strand steel cord with adequate rubber penetration coupled with a maximum load-carry capacity.

A steel cord adapted for the reinforcement of rubber products, comprises a core, this core can be a single wire, a single strand, multiple strands or a polymer element.

The steel cord further comprises three or more outer stands twisted around said core in a cord twisting direction.

Each of the three or more outer strands comprises outer strand filaments lying at the radially external side of the three or more outer strands. The steel outer filaments are twisted in with a strand twisting direction which is the same as the cord twisting direction.

The three or more outer strands have a wavy form.

Preferably, the wavy form is a crimp form obtainable by means of at least one pair of toothed wheels. Crimps may also be obtained by a set of cams. A crimp is a planar wave. However, depending upon the way of twisting, by means of a tubular twisting machine (=cabling) or by means of a double-twister (=bunching) the planar wave may not rotate or rotate.

The wavy form may be a double crimp obtainable by means of two pairs of toothed wheels. The strand is first provided with a first crimp lying in a first plane by the first pair of toothed wheels. The strand is further provided with a second crimp lying in a second plane substantially different from the first plane by the second pair of toothed wheels.

The amplitude of the wavy form ranges from 1.10 to 2.0 times of the diameter of the strand. If the amplitude of the wavy form is smaller than 1.10 times of the diameter of the strand, the spacing between the strands is too small to allow rubber penetration. If the amplitude of the wavy form is bigger than 2.0 times of the diameter of the strand, the spacing between the strands is too big, and cut the load-carrying capacity of the cord.

The pitch of the wavy form ranges from 4.0 to 8.0 times of the diameter of the strand. If the pitch of the wavy form is smaller than 4.0 times of the diameter of the strand, the spacing between the strands is too big, and cut the load-carry capacity of the cord. If the pitch of the wavy form is greater than 8.0 times of the diameter of the strand, the spacing between the strands is too small to allow rubber penetration.

Preferably, the core of the steel cord is a strand of core filaments. The core filaments are twisted in a core twisting direction which is the same as the cord twisting direction.

A steel cord according to the invention may be used as a as reinforcement for an off-the-road tire, e.g. in one of the outermost belt layers of the off-the-road tire.

BRIEF DESCRIPTION OF FIGURES IN THE DRAWINGS

The invention will now be described into more detail with reference to the accompanying drawings.

FIG. 1 schematically shows a cross-sectional view of a steel cord incorporating present invention. A steel cord 10 adapted for the reinforcement of rubber products, comprises a core 12, which is a single strand, and 6 outer strands 14 twisted around the core 12. The outer strand 14 further comprises seven steel filaments 16. Since the outer strands 14 are crimped into wavy form, there are spaces between the core 12 and the adjacent outer strands 14.

Figure 2:
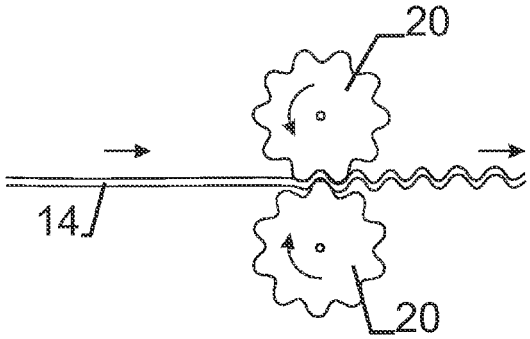

FIG. 2 schematically illustrates the method to make outer strand 14 wavy. Outer strand 14 goes through a pair of toothed wheels 20, and the outer strand 14 is crimped into wavy form. Besides, the toothed wheels 20 are not driven by external means, but driven and rotated by the passing outer strand 14.

Figure 3:
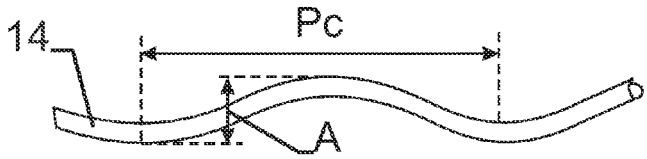

FIG. 3 shows a schematic diagram of a crimped outer stand 14 in wavy form. The amplitude A of the wavy form is between 1.10 to 2.0 times of the diameter of the outer stand 14, while the pitch Pc of the wavy form is between 4.0 to 8.0 times of the diameter of the outer strand 14.

Figure 4:
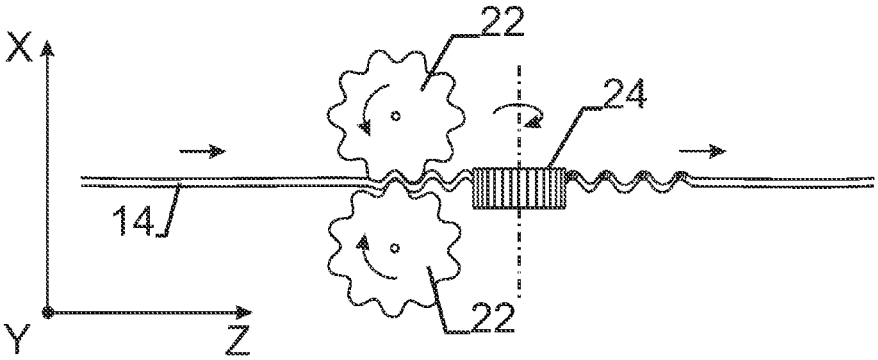

FIG. 4 schematically illustrates the method to make outer strand 14 into a double crimp. The outer strand 14 moves downstream towards a first pair of toothed wheels 22. The axes of rotation of toothed wheels 22 lie parallel to the y-axis, and the first crimp is a planar crimp lying in plane xz. The thus crimped outer strand 14 is further moves to a second pair of toothed wheels 24. The axes of rotation of toothed wheels 24 lie parallel with the x-axis. The second crimp given by toothed wheels 24 is also a planar crimp and lies in plane yz. Therefore, the resulting wave given to the outer strand 14 is no longer planar but spatial.

Neither the first pair of toothed wheels 22 nor the second pair of toothed wheels 24 needs to be driven by external means. They are both driven and rotated by the passing outer strand 14.

It is important that the second pair of toothed wheel 24 is positioned as close as possible to the first pair of toothed wheels 22 in order to prevent the first crimp from tilting or rotating from plane xz to plane yz under the influence of the second crimp.

Figure 5:
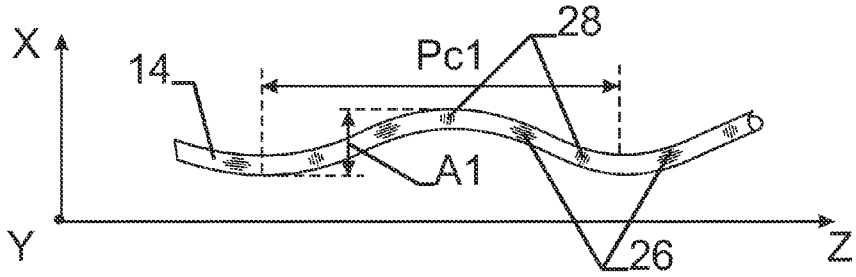

FIG. 5 shows the first crimp lying in plane xz. The first crimp has a first crimp amplitude A1, which is measured from top to top with inclusion of strand diameter. The first crimp has a first crimp pitch Pc1, which is equal to the distance between two minima of the first crimp.

Figure 6:
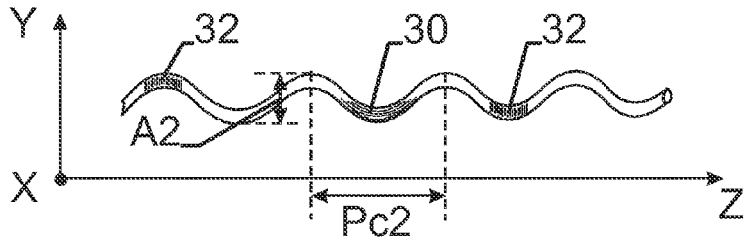

FIG. 6 shows the second crimp lying in plane yz. The second crimp has a second crimp amplitude A2, which is measured from top to top with inclusion of strand diameter. The second crimp has a second crimp pitch Pc2, which is equal to the distance between two minima of the second crimp. The spots 26 where the second crimp reaches its maxima are hatched in parallel with the axis of the outer strand 14, and the spots 28 where the second crimp reaches its minima are hatched vertically in FIG. 5. The spots 30 where the first crimp reaches its maxima are hatched in parallel with the axis of the outer strand 14, and the spots 32 where the first crimp reaches its minima are hatched vertically in FIG. 6.

Both the first crimp amplitude A1 and the second crimp amplitude A2 may be varied independently of each other. So A1 may be equal to A2 or may be different from A2. Both amplitudes may vary between 1.10 to 2.0 times of the diameter of the outer strand 14. Both the first crimp pitch Pc1 and the second crimp pitch Pc2 may be varied independently of each other. So Pc1 may be equal to Pc2 or may be different from Pc2. The more Pc1 differs from Pc2, the easier it is to prevent the first crimp from tilting. Both pitches may vary between 4.0 to 8.0 times of the diameter of the outer strand 14. it is, however, to be preferred, that in twisted structures at least one, and most preferably both, of the crimp pitches is smaller than the cord twist pitch of steel cord 10.

MODE(S) FOR CARRYING OUT THE INVENTION

Figure 7:
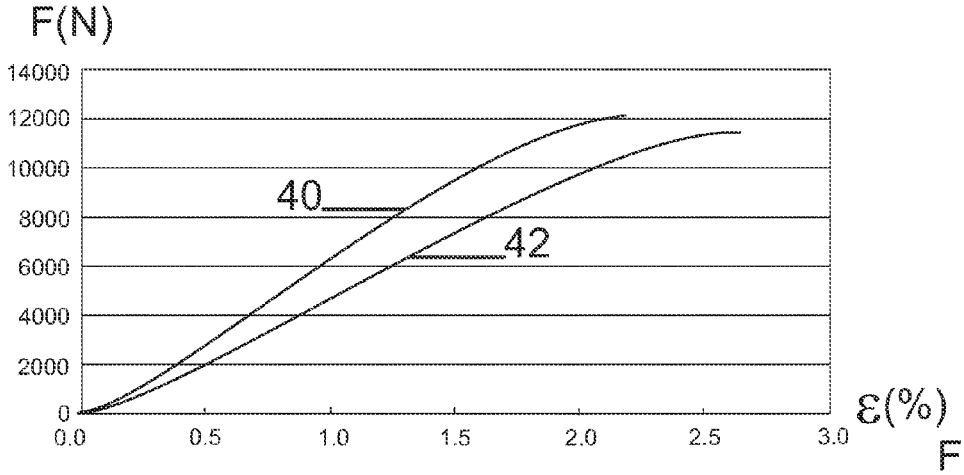

FIG. 7 illustrates the mechanical characteristics of two steel cords: a 7×7 SSS steel cord 10 and a reference cord in which the outer strands are not crimped in wavy form. Curve 42 is the load-elongation curve for the 7×7 SSS steel cord according to the invention, while curve 40 is the load-elongation curve for the reference 7×7 steel cord. Compared with the reference cord, the steel cord according to the present invention has an improvement on elongation at break of 30%.

Figure 8:
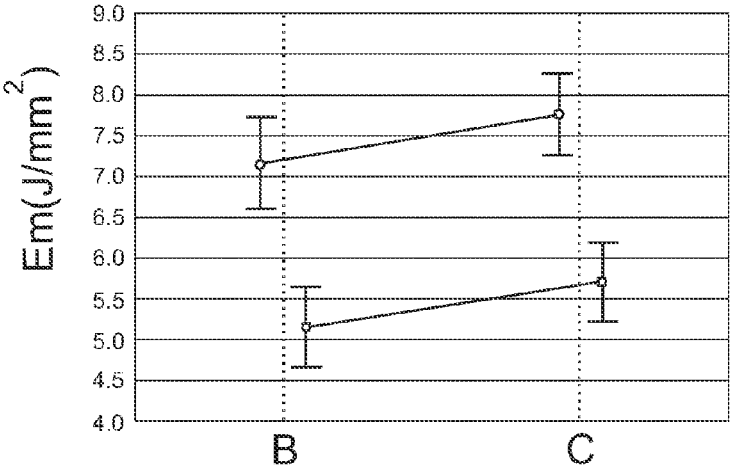

FIG. 8 illustrates the improvements of impact resistance capacity of steel cord according to the present invention. The vertical axis Em means the energy dissipated during the time between the first contact and maximum deceleration in the impact test. For a 7×7 SSS steel cord without wavy form, the Em is 7.2 J/mm$^2$, while for 7×7 SSS steel cord according to the present invention, the Em is 7.8 J/mm$^2$. The 7×7 SSS steel cord according to the present invention improves impact resistance capacity by 8.3% to absorb impact energy compared with the reference cord. For a 7×7 SSZ steel cord without wavy form, the Em is 5.2 J/mm$^2$, while for 7×7 SSZ steel cord according to the present invention, the Em is 5.8 J/mm$^2$. The 7×7 SSZ steel cord according to the present invention improves impact resistance capacity by 11.5% to absorb impact energy compared with the reference cord. From above comparison test the 7×7 SSS steel cord according to the present invention has the highest impact resistance capacity. Moreover, steel cord according to the present invention has improvements on impact resistance.

MODE(S) FOR CARRYING OUT THE INVENTION

A 7×7 SSS steel cord 10 according to the invention was built as follows:

Core strand 12 comprises one core filament with diameter of 0.365 mm and six peripheral filaments with diameter of 0.35 twisted around the core filaments in S direction with twisting pitch 18 mm.

Outer strands 14 comprise one core filament with diameter of 0.34 mm and six peripheral filaments 16 with diameter of 0.34 mm twisted around the core filament in S direction with twisting pitch 18 mm and the diameter of the outer strands 14 is 1.02 mm.

Outer strands 14 are further crimped by a pair of toothed wheels into a wavy form, while the amplitude is 1.5 mm, and the pitch is 5.3 mm.

Six outer strands 14 are twisted around the core strand 12 in S direction with twisting pitch 28 mm.

This 7×7 SSS steel cord diameter is around 3.2 mm.

The invention claimed is:

1. A steel cord adapted for reinforcement of rubber products, said steel cord comprising a core, said steel cord further comprising three or more outer strands twisted around said core in a cord twisting direction, each of said three or more outer strands comprising outer strand filaments lying at a radially external side of said three or more outer strands, said outer strand filaments twisted with a strand twisting direction equal to said cord twisting direction, said three or more outer strands having a wavy form, wherein said wavy form has an amplitude ranging from 1.10 to 2.0 times of a diameter of one or more outer strands.

2. A steel cord adapted for reinforcement of rubber products, said steel cord comprising a core, said steel cord further comprising three or more outer strands twisted around said core in a cord twisting direction, each of said three or more outer strands comprising outer strand filaments lying at a radially external side of said three or more outer strands, said outer strand filaments twisted with a strand twisting direction equal to said cord twisting direction, said three or more outer strands having a wavy form, wherein said wavy form has a pitch ranging from 4.0 to 8.0 times of a diameter of one or more outer strands.

3. A steel cord adapted for reinforcement of rubber products, said steel cord comprising a core, said steel cord further comprising three or more outer strands twisted around said core in a cord twisting direction, each of said three or more outer strands comprising outer strand filaments lying at a radially external side of said three or more outer strands, said outer strand filaments twisted with a strand twisting direction equal to said cord twisting direction, said three or more outer strands having a wavy form, wherein said wavy form is a crimp form obtainable by at least one pair of toothed wheels, wherein said wavy form has an amplitude ranging from 1.10 to 2.0 times of a diameter of one or more outer strands.

* * * * *